United States Patent [19]

Langdon

[11] Patent Number: 4,761,669

[45] Date of Patent: Aug. 2, 1988

[54] HIGHLIGHT COLOR PRINTING

[75] Inventor: Michael J. Langdon, Pittsford, N.Y.

[73] Assignee: Xerox Corporation, Stamford, Conn.

[21] Appl. No.: 52,650

[22] Filed: May 21, 1987

[51] Int. Cl.[4] ..... G03G 15/01

[52] U.S. Cl. ..... 355/4; 355/3 R; 355/10; 346/157; 346/159; 430/43; 430/53; 430/54

[58] Field of Search ..... 355/4, 3 R, 10; 346/157, 159, 160; 430/42, 44, 53, 54

[56] References Cited

U.S. PATENT DOCUMENTS

| | | | |
|---|---|---|---|
| 4,155,093 | 5/1979 | Fotland et al. | 346/159 |
| 4,236,809 | 12/1980 | Kermish | 355/4 |
| 4,255,043 | 3/1981 | Hoshino et al. | 346/159 X |
| 4,336,994 | 6/1982 | Banton | 430/44 X |
| 4,403,848 | 9/1983 | Snelling | 355/4 |
| 4,456,367 | 6/1984 | Szymanski et al. | 355/10 |
| 4,509,850 | 4/1985 | Weigl | 355/3 DD X |
| 4,515,462 | 5/1985 | Yoneda | 355/4 |
| 4,540,272 | 9/1985 | Abe et al. | 355/4 |
| 4,578,331 | 3/1986 | Ikeda et al. | 430/42 |
| 4,660,059 | 4/1987 | O'Brien | 346/157 |

FOREIGN PATENT DOCUMENTS

| | | | |
|---|---|---|---|
| 0179253 | 4/1986 | European Pat. Off. | 355/4 |
| 3329714 | 2/1984 | Fed. Rep. of Germany . | |
| 60-17463 | 1/1985 | Japan . | |

*Primary Examiner*—A. T. Grimley
*Assistant Examiner*—Jane K. Lau
*Attorney, Agent, or Firm*—H. Fleischer; J. E. Beck; R. Zibelli

[57] ABSTRACT

An electrophotographic printing machine in which indicia are printed on a sheet in at least two different colors. An electrostatic latent image is recorded on a photoconductive member and developed with a liquid developer material of one color. The latent image is neutralized and ions projected onto the photoconductive member in an image wise pattern to record another latent image. This latent image is developed with a liquid developer of another color. Both liquid images are transferred substantially simultaneously to a sheet to print indicia in two colors thereon.

17 Claims, 2 Drawing Sheets

HIGHLIGHT COLOR PRINTING

Figure 1:
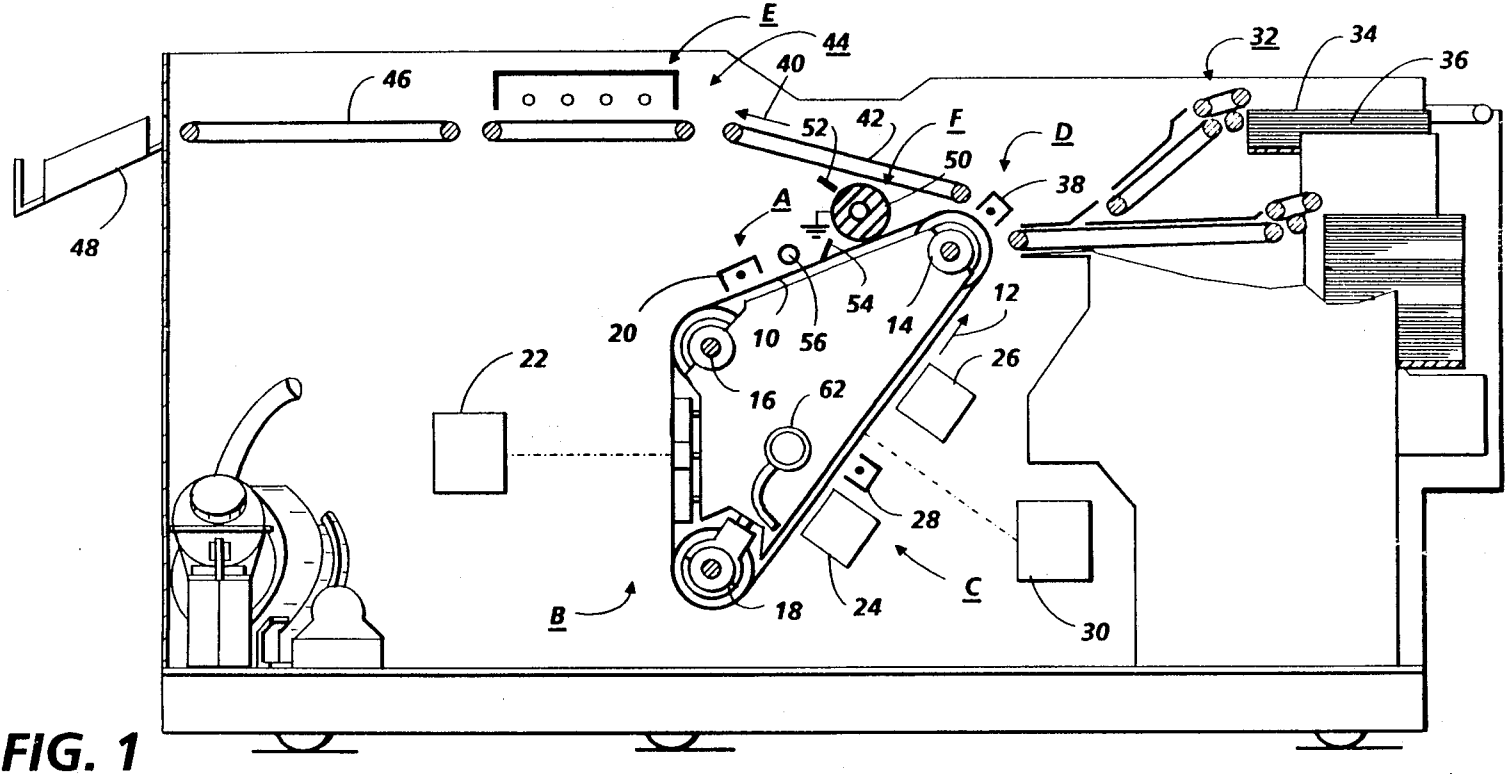

This invention relates generally to a highlight color printing machine, and more particularly concerns a printing machine in which indicia on a sheet are printed in at least two different colors.

Hereinbefore, multicolor copying was achieved by using a multicolor electrophotographic printing machine. In the process of electrophotographic printing, a photoconductive surface is charged to a substantially uniform potential. The photoconductive surface is image wise exposed to record an electrostatic latent image corresponding to the informational areas of an original document being reproduced. This records an electrostatic latent image on the photoconductive surface corresponding to the informational areas contained within the original document. Thereafter, a developer material is transported into contact with the electrostatic latent image. Toner particles are attracted from the carrier granules of the developer material onto the latent image. The resultant toner powder image is then transferred from the photoconductive surface to a copy sheet and permanently affixed thereto. The foregoing generally describes a typical black and white electrophotographic copying machine. With the advent of multicolor electrophotographic printing, the process is repeated for three or four cycles. Thus, the charged photoconductive surface is exposed to a filtered light image. The resultant electrostatic latent image is then developed with toner particles corresponding in color to the subtractive primary of the filtered light image. For example, when a red filter is employed, the electrostatic latent image is developed with cyan toner particles. The cyan toner powder image is then transferred to the copy sheet. The foregoing process is repeated for a green filtered light image which is developed with magenta toner particles and a blue filtered light image which is developed with yellow toner particles. Each differently colored toner powdered image is sequentially transferred to the copy sheet in superimposed registration with the powder image previously transferred thereto. In this way, three toner powder images are transferred sequentially to the copy sheet. After the toner powder images have been transferred to the copy sheet, they are permanently fused thereto. Thus, color electrophotographic machines previously employed required three passes to produce a multicolor copy. This, of course, reduced the speed of the printing machine. A typical electrophotographic printing machine employing the foregoing process is manufactured by the Xerox Corporation under the model name 1005.

Recently, electrophotographic printing machines have been developed which produce highlight color copies. A typical highlight color printing machine records successive electrostatic latent images on the photoconductive surface. When combined, these electrostatic latent images form a total latent image corresponding to the entire original document being reproduced. One latent image is usually developed with black toner particles. The other latent image is developed with color highlighting toner particles, e.g. red toner particles. These developed toner images are transferred to the copy sheet to form the color highlighted copy.

With the advent of ion projection devices, an electrostatic latent image can be deposed upon a charge receptor surface. The resultant charge pattern may then be developed in a conventional manner. A printing machine utilizing an ion projection system is a relatively simple device and less complex than those previously employed. Moreover, an ion projection apparatus may be employed in a multicolor or highlight color electrophotographic printing machine. Various types of ion projection devices have been developed. These are described in U.S. Pat. No. 4,538,163, issued on Aug. 27, 1985. to Sheridon; U.S. Pat. No. 4,463,363, issued on July 31, 1984 to Gundlach et al; U.S. Pat. No. 4,409,604, issued on Oct. 11, 1983 to Fotland; U.S. Pat. No. 4,408,214, issued on Oct. 4, 1983 to Fotland et al; U.S. Pat. No. 4,365,549, issued on Dec. 28, 1982 to Fotland et al; U.S. Pat. No. 4,267,556, issued on May 12, 1981 to Fotland et al; U.S. Pat. No. 4,160,257, issued on July 30, 1979 to Carrish; and U.S. Pat. No. 4,155,093 issued on May 15, 1979 to Fotland et al. All of the foregoing patents describe various types of ion projection devices which may be employed in printing systems to produce a charge pattern on a charge receiving surface.

In highlight color and multicolor electrophotographic printing, it is highly desirable to simultaneously transfer the developed images to the copy sheet rather than having to do it sequentially. Various approaches have been devised to produce multicolor and highlight color copies. The following disclosures appear to be relevant:

U.S. Pat. No. 4,515,462
Patentee: Yoneda
Issued: May 7, 1985
U.S. Pat. No. 4,540,272
Patentee: Abe et al.
Issued: Sept. 10, 1985
U.S. Pat. No. 4,578,331
Patentee: Ikeda et al.
Issued: Mar. 25, 1986
U.S. Pat. No. 4,660,059
Patentee: O'Brien
Issued: Apr. 21,1987
German Publication No. DE 3329714A1
Published: Feb. 23, 1984
Applicant: Amitani et al.
Japanese Patent Publication No. 60-17463
Published: Jan. 29, 1985
Applicant: Ikeda et al.

The disclosures of the above-identified art may be briefly summarized as follows:

Yoneda discloses a multicolor image forming apparatus comprising three light sources, two charging units, two developing units, a photoconductive drum, having a photoconductive layer, and a transparent insulating layer. The drum is charged by a primary charger of one polarity and is completely exposed. Thereafter, a secondary charger charges the transparent insulating layer at a second polarity. Laser beams are used as light sources disposed in front of the chargers with intensities proportional to color image data.

Abe et al. describes a multicolor printing device in which a plurality of developing devices develop the colors of an electrostatic latent image selectively corresponding to the respective colors on a latent image formation medium.

Ikeda et al. ('331) and Ikeda et al. ('463) disclose color photocopying machines in which light beams of the three primary colors, yellow, magenta, and cyan, represent image information for a color document and are projected onto a photosensitive member to form electrostatic latent images. These images are then developed using both DC and AC bias voltages and three different color toners, each at a separate transfer-printing developing station.

Figure 2:
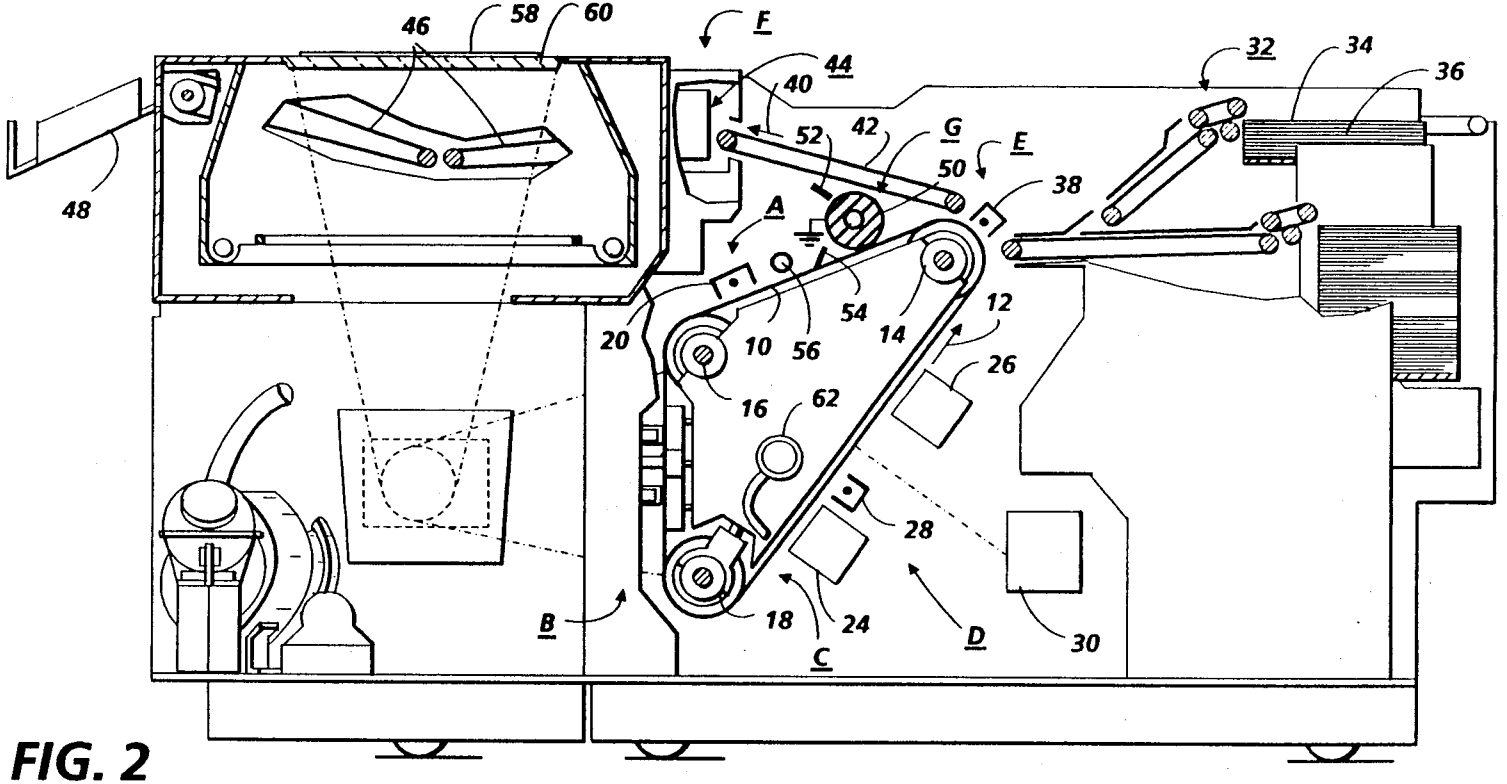

In FIG. 2, O'Brien describes a color printing machine having an ion projection unit for recording an image wise charge pattern on a dielectric roller. The charge pattern is developed with black toner particles and neutralized by a corona generating device. Another ion projection unit records another image wise charge pattern on the dielectric roller which is developed with red toner particles. The black and red toner particles are transferred to a copy sheet and permanently fused thereto.

Amitani et al. discloses a multicolor photocopier using split optics to scan an image directly onto different color process cylinders to produce a multicolor copy in a single pass of the optic scanner and one rotation of the process drums.

In accordance with the features of the present invention, there is provided an electrophotographic printing machine in which indicia are printed on a sheet in at least two different colors. The printing machine includes a photoconductive member wherein means record a first electrostatic latent image thereon. Means develop the first electrostatic latent image with a liquid developer material of a first color to from a first color liquid image on the photoconductive member. Means are provided for substantially neutralizing the first electrostatic latent image after it has been developed. Means project ions in an image wise pattern onto the photoconductive member to record a second electrostatic latent image thereon. Means develop the second electrostatic latent image with a liquid developer material of a second color to form a second color liquid image on the photoconductive member with the second color liquid image being a different color than the first color liquid image. Means transfer substantially simultaneously the first color liquid image and the second color liquid image from the photoconductive member to the sheet to print indicia in two colors thereon.

Pursuant to another aspect of the present invention, there is provided a method of printing indicia on a sheet in at least two different colors. The method of printing includes recording a first electrostatic latent image on a photoconductive member. The first electrostatic latent image is developed with a liquid developer material of a first color to form a first color liquid image on the photoconductive member. The first electrostatic latent recorded on the photoconductive member is neutralized after the first color liquid image has been developed thereon. An image wise pattern of ions is projected onto the photoconductive member to record a second electrostatic latent image thereon. The second electrostatic latent image is developed with a liquid developer material of a second color to form a second color liquid image on the photoconductive member with the second color liquid image being of a different color than the first color liquid image. The first color liquid image and the second color liquid image are transferred substantially simultaneously from the photoconductive member to the sheet to print indicia in two colors thereon.

Other aspects of the present invention will become apparent as the following description proceeds and upon reference to the drawings, in which:

FIG. 1 is a schematic elevational view showing one embodiment of an electrophotographic printing machine incorporating the features of the present invention therein; and FIG. 2 depicts another embodiment of the FIG. 1 printing machine.

While the present invention will hereinafter be described in conjunction with various embodiments thereof, it will be understood that it is not intended to limit the invention to these embodiments. On the contrary, it is intended to cover all alternatives, modifications, and equivalents as may be included in the spirit and scope of the invention as defined by the appended claims.

For a general understanding of the features of the present invention, reference is made to the drawings. In the drawings, like reference numerals have been used throughout to designate identical elements. FIG. 1 schematically depicts the various components of an electrophotographic printing machine incorporating the features of the present invention therein. It will become evident from the following discussion that the features of the present invention are equally well suited for use in a wide variety of electrostatographic printing machines and are not necessarily limited in their application to the particular embodiments depicted herein.

Inasmuch as the art of electrostatographic printing is well known, the various processing stations employed in the FIG. 1 printing machine will be shown hereinafter and their operation described briefly with reference thereto.

As shown in FIG. 1, the illustrative printing machine employs a belt 10 having a photoconductive surface deposited on a conductive substrate. Preferably, the photoconductive surface is made from a selenium alloy with the conductive substrate being made from an electrically grounded aluminum alloy. Other suitable photoconductive surfaces and conductive substrates may also be employed. Belt 10 moves in the direction of arrow 12 to advance successive portions of the photoconductive surface through the various processing stations disposed about the path of movement thereof. Belt 10 is supported by three rollers 14, 16, and 18 located with parallel axes at approximately the apexes of a triangle. Roller 14 is rotatably driven by a suitable motor associated with a drive (not shown) to move belt 10 in the direction of arrow 12.

Initially, a portion of belt 10 passes through charging station A. At charging station A, a corona generating device, indicated generally by the reference numeral 20, charges the photoconductive surface of belt 10 to a relatively high, substantially uniform potential.

Next, the charged portion of the photoconductive surface is advanced through imaging station B. At imaging station B, an imaging unit 22 records an electrostatic latent image on the photoconductive surface of belt 10. Imaging unit 22 includes a raster output scanner. The raster output scanner lays out the electrostatic latent image in a series of horizontal scan lines with each line having a specified number of pixels per inch. Preferably, the raster output scanner employs a laser which generates a beam of light rays that are modulated by rotating polygon mirror blocks or solid state image modulator bars. Alternatively, the raster output scanner may use light emitting diode array write bars. In this way, the first electrostatic latent image is recorded on the photoconductive surface of belt 10. When forming a multicolor copy, a plurality or at least two electrostatic latent images are recorded on dielectric layer 10. At this time, however, only the first or initial electrostatic latent image is recorded thereon. The electrostatic latent image recorded on the photoconductive surface of belt 10 is advanced to development station C as belt 10 moves in the direction of arrow 12.

At development station C, a developing liquid comprising a clear insulating carrier liquid and black or colored toner particles, contacts the electrostatic latent image. Development station C includes two developer units 24 and 26 mounted on the printing machine frame. Developer unit 24 contains clear carrier and black toner. Developer unit 26 has the clear carrier and the toner in the operator selected highlight color. One skilled in the art will appreciate that the developer materials in the respective developer units may be reversed, i.e. developer unit 26 may have clear carrier and black toner with developer unit 24 having the clear carrier and the toner in the operator selected highlight. Accordingly, developer units 24 and 26 are substantially identical to one another with the only distinction being the color of the toner contained therein. Preferably, the developer material used in each developer unit includes a clear liquid insulating carrier having pigmented particles, i.e. toner particles, dispersed therein. A suitable clear insulating liquid carrier may be made from an aliphatic hydrocarbon, such as an Isopar, which is a trademark of the Exxon Corporation, having a low boiling point. The toner particles include a pigment associated with a polymer. A suitable liquid developer material is described in U.S. Pat. No. 4,582,774, issued to Landa in 1986, the relevant portions thereof being incorporated into the present application. Developer unit 24 has a developing liquid comprising a clear insulating carrier liquid and black toner particles. The developing liquid is circulated by a pump from a container through a pipe into a development tray mounted on the frame of the printing machine. A development electrode, which may be appropriately electrically biased, assists in developing the electrostatic latent image with the black developing liquid. The charged toner particles, disseminated throughout the carrier liquid, pass by electrophoresis to the electrostatic latent image. The charge of the toner particles is opposite in polarity to the charge on the photoconductive surface. By way of example, if the photoconductive surface is made from a selenium alloy, the photoconductive surface will be positively charged and the toner particles will be negatively charged. Alternatively, if the photoconductive surface is made from a cadmium sulfide material, the photoconductive surface will be negatively charged and the toner particles will be positively charged. Generally, the amount of liquid carrier on the photoconductive surface is too great. A roller (not shown) whose surface moves in a direction opposite to the direction of movement of the photoconductive surface, is spaced from the photoconductive surface and adapted to shear excessive liquid from the developed image without disturbing the image. After development of the portion of the latent image adapted to be in black is completed, belt 10 continues to move in the direction of arrow 12 to advance the black liquid image beneath corona generating unit 28. Corona generating unit 28 is coupled to a voltage source. The voltage source electrically biases corona generator 28. Thus, corona generator 28 is excited by an A.C. voltage superimposed over a D.C. bias level. This erases the electrostatic latent image and increases the net charge of the black liquid image to tack it to the photoconductive surface electrostatically. This also prevents back development during development of the next electrostatic latent image. If necessary, an erase lamp can be used to help neutralize the first electrostatic latent image. The black liquid image on the photoconductive surface of belt 10 advances now to imaging unit 30. Imaging unit 30 includes an ion projector that generates a flow or stream of ions which are modulated and deposited on the photoconductive surface of belt 10 in those regions where color highlighted information is to be displayed, i.e. the red portions of the sheet. A suitable ion generator having modulation electrodes is described in U.S. Pat. No. 4,538,163, issued on Aug. 27, 1985 to Sheridon, the relevant portions thereof being hereby incorporated into the present application. This second electrostatic latent image is now advanced to developer unit 26. Developer unit 26 contains a color highlight developer liquid therein, e.g. a red developer liquid. Developer unit 26 is electrically biased to a higher level than developer unit 24 so that the non-electrostatic latent image areas on photoconductive surface are low field regions. In this way, the red liquid developer is only attracted to the second electrostatic latent image. At this time, the photoconductive surface of belt 10 has both red and black toner and clear liquid carrier thereon. This forms a black liquid image and a color highlight liquid image, i.e. a red liquid image. As belt 10 continues to move in the direction of arrow 12, both of these differently colored liquid images are advanced to transfer station D.

At transfer station D, a copy sheet is moved into contact with both the red and black liquid images on belt 10. The copy sheet is advanced to transfer station D by a sheet feeding apparatus, indicated generally by the reference numeral 32. Copy sheet 34 is advanced from stack 36 by sheet feeder 32 into contact with the liquid images on belt 10 beneath corona generating unit 38 at transfer station D. Corona generating unit 38 sprays ions onto the backside of sheet 34 to attract the liquid images to the front side thereof. After transfer, copy sheet 34 continues to move in the direction of arrow 40 on conveyor 42 to fusing station E.

Fusing station F includes a radiant fusing system, indicated generally by the reference numeral 44, which vaporizes the liquid carrier from the copy sheet and permanently fuses the black and red toner, in image configuration, thereto. This forms a color highlighted copy. After fusing, the copy sheet is advanced by conveyor 46 to catch tray 48 for subsequent removal from the printing machine by the operator.

Some residual liquid developer material remains adhering to the photoconductive surface of belt 10 after transfer. This residual developer material is removed from the photoconductive surface at cleaning station F. Cleaning station F includes a cleaning roller 50, formed of any appropriate synthetic resin driven in a direction opposite to the direction of movement of the photoconductive surface to scrub the photoconductive surface clean. To assist in this action, liquid carrier may be fed through pipe 52 onto the surface of cleaning roller 50. A wiper blade 54 completes the cleaning of the photoconductive surface. Any residual charge left on the photoconductive surface is extinguished by flooding the photoconductive surface with light from lamp 56.

Referring now to FIG. 2, there is shown another embodiment of the printing machine. As shown thereat, the printing machine employs a belt 10 having a photoconductive surface deposited on a conductive substrate. Preferably, the photoconductive surface is made from a selenium alloy with the conductive substrate being made from an electrically grounded aluminum alloy. Other suitable photoconductive surfaces and conductive substrates may also be employed. Belt 10 moves in the direction of arrow 12 to advance successive portions of the photoconductive surface through the various processing stations disposed about the path of movement therof. Belt 10 is supported by three rollers 14, 16, and 18 located with parallel axes at approximately the apexes of a triangle. Roller 14 is rotatably driven by a suitable motor associated with a drive (not shown) to move belt 10 in the direction of arrow 12.

Initially, a portion of belt 10 passes through charging station A. At charging station A, a corona generating device, indicated generally by the reference numeral 20, charges the photoconductive surface of belt 10 to a relatively high, substantially uniform potential.

Next, the charged portion of the photoconductive surface is advanced through exposure station B. At exposure station B, an original document 58 is positioned face down upon a transparent platen 60. Lamps flash light rays onto original document 58. The light rays reflected from original document 58 are transmitted through a lens forming a light image thereof. The lens focuses the light image onto the charged portion of the photoconductive surface to selectively dissipate the charge thereon. This records an electrostatic latent image on the photoconductive surface corresponding to the informational areas contained within the original document. Thereafter, belt 10 advances the electrostatic latent image recorded on photoconductive surface 12 to editing station C.

Editing station C includes a plurality of small lamps, e.g. photodiodes, extending across belt 10 in a direction substantially perpendicular to the direction of movement thereof, as indicated by arrow 12. A key pad (not shown) on the printing machine is used to select the coordinates of the region of the copy to be reproduced as a highlight color. Platen 58, upon which original document 60 is positioned, has a coordinate grid thereon. This enables the operator to select the coordinates of the copy to be reproduced in a highlight color. These coordinates are keyed into the control system of the printing machine by the operator selecting the appropriate keys of the key pad. The control system actuates selected lamps of light source 62 at the appropriate time in the cycle to erase the portion of the electrostatic latent image corresponding to the region of the copy to be reproduced in a highlight color. The detailed structure of an editing system of this type is described in U.S. Pat. No. 4,582,417 issued to Yagasaki et al. on Apr. 15, 1986, the relevant portions thereof being hereby incorporated into the present application by reference thereto. The remaining portion of the electrostatic latent image is advanced to development station D.

At development station D, a developing liquid comprising a clear insulating carrier liquid and colored toner particles, contacts the electrostatic latent image. Development station D includes two developer units 24 and 26 mounted on the printing machine frame. Developer unit 24 contains clear carrier and black toner. Developer unit 26 has the liquid developer in the operator selected highlight color. Developer units 24 and 26 are substantially identical to one another with the only distinction being the color of the toner contained therein. Preferably, the developer material includes a clear liquid insulating carrier having pigmented particles, i.e. toner particles, dispersed therein A suitable clear insulating liquid carrier may be made from aliphatic hydrocarbon, such as an Isopar, which is a trademark of the Exxon Corporation, having a low boiling point. The toner particles include a pigment associated with a polymer. A suitable liquid developer material is described in U.S. Pat. No. 4,582,774, issued to Landa in 1986, the relevant portions thereof being incorporated into the present application. Developer unit 24 has a developing liquid comprising a clear insulating carrier liquid and black colored toner particles. The developing liquid is circulated by a pump from a container through a pipe into a development tray mounted on the frame of the printing machine A development electrode, which may be appropriately electrically biased, assists in developing the electrostatic latent image with the black developing liquid. The charged toner particles, disseminated throughout the carrier liquid, pass by electrophoresis to the electrostatic latent image. The charge of the toner particles is opposite in polarity to the charge on the photoconductive surface. Generally, the amount of liquid carrier on the photoconductive surface is too great. A roller (not shown) whose surface moves in a direction opposite to the direction of movement of the photoconductive surface, is spaced from the photoconductive surface and adapted to shear excessive liquid from the developed image without disturbing the image. After development of the portion of the latent image adapted to be in black is completed, belt 10 continues to move in the direction of arrow 12 to advance the black liquid image beneath corona generating unit 28. Corona generating unit 28 is coupled to a voltage source. The voltage source electrically biases corona generator 28. Thus, corona generator 28 is excited by an A.C. voltage superimposed over a D.C. bias level. This erases the electrostatic latent image and increases the net charge of the black liquid image to tack it to the photoconductive surface electrostatically. This also prevents back development during development of the next electrostatic latent image. If necessary, an erase lamp can be used to help neutralize the first electrostatic latent image. The black liquid image on the photoconductive surface of belt 10 advances now to imaging unit 30. Imaging unit 30 includes an ion projector that generates a flow or stream of ions which are modulated and deposited on the photoconductive surface of belt 10 in those regions where color highlighted information is to be displayed, i.e. the erased portions of the first electrostatic latent image. A suitable ion generator having modulation electrodes is described in U.S. Pat. No. 4,538,163, issued on Aug. 27, 1985 to Sheridon, the relevant portions thereof being hereby incorporated into the present application. This second electrostatic latent image is now advanced to developer unit 26. Developer unit 26 contains the color highlighted liquid developer material therein, e.g. red liquid developer material. Developer unit 26 is substantial identical to developer unit 24 with the distinction being in the color of the liquid developer material contained therein. Developer unit 26 is also electrically biased to a higher level than developer unit 24 so that the nonelectrostatic latent image areas on photoconductive surface are low field regions. In this way, the red liquid image is only attracted to the second electrostatic latent image. At this time, the photoconductive surface of belt 10 has both red and black toner and clear liquid carrier deposited thereon. This forms a black liquid image and a color highlight liquid image, i.e. a red liquid image. As belt 10 continues to move in the direction of arrow 12, both of these differently colored liquid images are advanced to transfer station E.

At transfer station E, a copy sheet is moved into contact with both the red and black liquid images on belt 10. The copy sheet is advanced to transfer station E by a sheet feeding apparatus, indicated generally by the reference numeral 32. Copy sheet 34 is advanced from stack 36 by sheet feeder 32 into contact with the liquid images on belt 10 beneath corona generating unit 38 at transfer station E. Corona generating unit 38 sprays ions onto the backside of sheet 34 to attract the liquid images to the front side thereof. After transfer, copy sheet 34 continues to move in the direction of arrow 40 on conveyor 42 to fusing station F.

Fusing station F includes a radiant fusing system, indicated generally by the reference numeral 44, which vaporizes the liquid carrier from the copy sheet and permanently fuses the toner, in image configuration, thereto. This forms a color highlighted copy. After fusing, the copy sheet is advanced by conveyors 46 to catch tray 48 for subsequent removal from the printing machine by the operator.

Some residual liquid developer material remains adhering to the photoconductive surface of belt 10 after transfer. This residual developer material is removed from the photoconductive surface at cleaning station G. Cleaning station G includes a cleaning roller 50, formed of any appropriate synthetic resin driven in a direction opposite to the direction of movement of the photoconductive surface to scrub the photoconductive surface clean. To assist in this action, developing liquid may be fed through pipe 52 onto the surface of cleaning roller 50. A wiper blade 54 completes the cleaning of the photoconductive surface. Any residual charge left on the photoconductive surface is extinguished by flooding the photoconductive surface with light from lamp 56.

In recapitulation, it is evident that the printing machine of the present invention records electrostatic latent images on a photoconductive member which are subsequently developed with different colored liquid developer materials. These differently colored liquid images are then transferred substantially simultaneously, to a sheet. The sheet then passes through a fusing station where the liquid images are permanently fused so that the indicia on the sheet are in at least two different colors.

It is, therefore, apparent that there has been provided in accordance with the present invention, an electrophotographic printing machine that fully satisfies the aims and advantages hereinbefore set forth. While this invention has been described in conjunction with various embodiments thereof, it is evident that many alternatives, modifications and variations will be apparent to those skilled in the art. Accordingly, it is intended to cover all such alternatives, modifications and variations that fall within the spirit and broad scope of the appended claims.

I claim:

1. An electrophotographic printing machine in which indicia are printed on a sheet in at least two different colors, including:

a photoconductive member;

means for recording a first electrostatic latent image on said photoconductive member;

first means for developing the first electrostatic latent image with a liquid developer material of a first color to form a first color liquid image on said photoconductive member;

means for substantially neutralizing the first electrostatic latent image recorded on said photoconductive member after said first developing means develops the first electrostatic latent image;

means for projecting ions in an image wise pattern onto said photoconductive member to record a second electrostatic latent image thereon;

means for developing the second electrostatic latent image with a liquid developer material of a second color to form a second color liquid image on said photoconductive member with the second color liquid image being a different color than the first color liquid image; and means for transferring substantially simultaneously the first color liquid image and the second color liquid image from said photoconductive member to the sheet to print indicia in two colors thereon.

2. A printing machine according to claim 1, wherein said recording means includes:

means for charging at least a portion of said photoconductive member to a substantially uniform potential; and means for irradiating the charged portion of said photoconductive member to selectively discharge the charged portion of said photoconductive member to record a first electrostatic latent image thereon.

3. A printing machine according to claim 2, wherein the first color liquid developer material includes a liquid carrier having particles of the first color dispersed therein.

4. A printing machine according to claim 3, wherein the second liquid developer material includes a liquid carrier having particles of the second color dispersed therein.

5. A printing machine according to claim 4, further including means for substantially permanently fusing the first color particles and the second color particles to the sheet.

6. A printing machine according to claim 5, wherein said projecting means includes:

means for generating a flow of ions toward said photoconductive member; and means for modulating the ions flowing toward said photoconductive member to deposit ions thereon in an image wise pattern to record the second electrostatic latent image thereon.

7. A printing machine according to claim 6, wherein said irradiating means includes a raster output scanner for illuminating the charged portion of said photoconductive member to record the first electrostatic latent image thereon.

8. A printing machine according to claim 7, wherein said raster output scanner includes:

a laser for generating a beam of energy; and means for modulating the beam of energy to selectively irradiate the charged portion of said photoconductive member to record the first electrostatic latent image thereon.

9. A printing machine according to claim 6, wherein said irradiating means includes means for forming a light image of an original document and projecting the light image onto the charged portion of said photoconductive member to selectively discharge the charge thereon to record the first electrostatic latent image thereon.

10. A printing machine according to claim 9, wherein the color of the first color particles is black and the color of the second color particles is of a color other than black.

11. A method of printing indicia on a sheet in at least two different colors, including the steps of:

recording a first electrostatic latent image on a photoconductive member;

developing the first electrostatic latent image with a liquid developer material of a first color to form a first color liquid image on the photoconductive member;

neutralizing the first electrostatic latent recorded on the photoconductive member after the first color liquid image has been developed thereon;

projecting ions in an image wise pattern onto the photoconductive member to record a second electrostatic latent image thereon;

developing the second electrostatic latent image with a liquid developer material of a second color to form a second color liquid image on the photoconductive member with the second color liquid image being of a different color than the first color liquid image; and transferring substantially simultaneously the first color liquid image and the second color liquid image from the photoconductive member to the sheet to print indicia in two colors thereon.

12. A method of printing according to claim 11, wherein said step of recording includes the steps of:

charging at least a portion of the photoconductive member to a substantially uniform potential; and irradiating the charged portion of the photoconductive member to selectively discharge the charged portion to record the first electrostatic latent image thereon.

13. A method of printing according to claim 12, wherein said step of projecting includes the steps of:

generating a flow of ions toward the photoconductive member; and modulating the ions flowing toward the photoconductive member to deposit ions thereon in an image wise pattern to record the second electrostatic latent image thereon.

14. A method of printing according to claim 13, wherein said step of irradiating includes the step of energizing a raster output scanner for illuminating the charged portion of the photoconductive member to record the first electrostatic latent image thereon.

15. A method of printing according to claim 14, wherein said step of energizing the raster output scanner includes the steps of:

generating a beam of energy; and modulating the beam of energy to selectively irradiate the charged portion of the photoconductive member to record the first electrostatic latent image thereon.

16. A method of printing according to claim 13, wherein said step of irradiating includes the step of forming a light image of an original document and projecting the light image onto the charged portion of the photoconductive member to selectively discharge the charge thereon to record the first electrostatic latent image thereon.

17. A method of printing according to claim 13, further including the step of fusing substantially permanently the first liquid image and the second liquid image to the sheet.

* * * * *